United States Patent [19]

Fushiya

[11] Patent Number: 4,836,063

[45] Date of Patent: Jun. 6, 1989

[54] BOLT TIGHTENING TOOL

[75] Inventor: Fusao Fushiya, Anjo, Japan

[73] Assignee: Makita Electric Works, Ltd., Anjo, Japan

[21] Appl. No.: 76,856

[22] Filed: Jul. 22, 1987

[30] Foreign Application Priority Data

Jul. 28, 1986 [JP] Japan ..... 61-115587[U]

[51] Int. Cl.[4] ..... B25B 17/00

[52] U.S. Cl. ..... 81/55; 403/330

[58] Field of Search ..... 81/55, 56, 57.16, 57.34; 173/12, 13; 403/330

[56] References Cited

U.S. PATENT DOCUMENTS 4,367,971 1/1983 Coren ..... 403/330

4,403,529 9/1983 Ikeda ..... 81/56

4,422,794 12/1983 Deken ..... 403/330

4,503,736 3/1985 Fushiya ..... 81/55

4,565,112 1/1986 Fujita ..... 81/56

*Primary Examiner*—James G. Smith

*Attorney, Agent, or Firm*—Dennison, Meserole Pollack & Scheiner

[57] ABSTRACT

A bolt tightening tool for tightening a nut onto a bolt which comprises an outer sleeve having a nut receiving bore and an engaging groove; an inner sleeve axially movably mounted within the outer sleeve and having a tip receiving bore; and a stopper tiltably disposed in the inner sleeve. The stopper has one end projectable into the tip receiving bore of the inner sleeve and the other end projectable into the engaging groove of the outer sleeve. When a tip is fitted into the tip receiving bore, the tip pushes the stopper to tiltingly move the latter away from the engaging groove, permitting the inner sleeve to retract axially and rendering a nut fittable in the nut receiving bore of the outer sleeve.

5 Claims, 4 Drawing Sheets

BOLT TIGHTENING TOOL

BACKGROUND OF THE INVENTION

1. Field of the Invention

The present invention relates to a bolt tightening tool for tightening a nut onto a bolt, and more particularly to such a bolt tightening tool which may prevent incomplete fitting of a tip of a bolt in an inner sleeve of the tool.

2. Description of the Prior Art

In general, a bolt tightening tool includes an inner sleeve and an outer sleeve which are coupled to a drive. The inner sleeve is fitted to a tip of a bolt to be sheared, and the outer sleeve is fitted to a nut screwed on the bolt. The outer sleeve is rotated by the drive to thereby tighten the nut onto the bolt. Simultaneously therewith, the tip in the inner sleeve is sheared as it is subjected to the tightening reaction of the outer sleeve applied to the nut.

In such a bolt tightening tool, however, even when the tip has been fitted in the inner sleeve incompletely, the nut will be fitted in the outer sleeve, causing the latter to rotate. This causes damage to the tip or the bolt and allows the tightening reaction to act inadvertently on the operator by way of the tightening tool, thereby resulting in accident.

Various devices and systems have been devised heretofore to eliminate the aforenoted disadvantages. For example, U.S. Pat. Nos. 4,403,529 and 4,503,736 disclose means for preventing incomplete fitting of a tip of a bolt wherein an inner sleeve is allowed to retract only when the tip is fitted in the inner sleeve completely or properly, thereby permitting an outer sleeve to receive a nut therein. The mechanisms disclosed in these patents, however, are complicated in construction, and the number of components is increased including, for example, means for sensing complete fitting of a tip into a tip receiving bore and means for temporarily holding a sheared tip. Thus, the assembling procedure is cumbersome, and the mechanisms or devices are relatively expensive to manufacture.

SUMMARY OF THE INVENTION

It is, accordingly, an object of the present invention to provide a bolt tightening tool which may ensure proper fitting of a nut and a tip of a bolt into an outer sleeve and an inner sleeve, respectively, so as to tighten the nut onto the bolt properly and improve the safety of operation.

It is another object of the present invention to provide a bolt tightening tool including means for preventing incomplete fitting of a tip of a bolt which includes a minimum of components, and which is easy to assemble and relatively inexpensive to manufacture.

According to the present invention, there is provided a bolt tightening tool for tightening a nut onto a bolt, of the type driven by an electric motor. The bolt tightening tool includes an outer sleeve rotatably coupled to the electric motor and an inner sleeve mounted within the outer sleeve for axial movement relative thereto. The outer sleeve has a nut receiving bore for fitting therein a nut to be tightened and has an engaging groove of a predetermined width formed adjacent the nut receiving bore. The inner sleeve has a tip receiving bore for fitting therein a tip of a bolt to be sheared. The inner sleeve also has an axial recess formed in the outer periphery of the forward end thereof in generally opposed relation to the engaging groove of the outer sleeve, and an aperture formed in the forward end of the recess and communicating with the tip receiving bore. A stopper is tiltably mounted within the axial recess of the inner sleeve. The stopper has a base portion projectable into the tip receiving bore of the inner sleeve and an engaging portion projectable into the engaging groove of the outer sleeve. The inner sleeve has on the outer periphery thereof biasing means for normally urging the base portion to project into the tip receiving bore and for normally urging the engaging portion to project into the engaging groove.

When a nut is to be tightened onto a bolt, the tip receiving bore of the inner sleeve is fitted to the tip of the bolt. The tip inserted in the inner sleeve then pushes the stopper to tiltingly move the latter away from the engaging groove of the outer sleeve. As a result, the stopper will release the restraint of the inner sleeve on the outer sleeve, so that the inner sleeve moves axially relative to the outer sleeve, permitting the nut to fit in the nut receiving bore of the outer sleeve. The outer sleeve is then rotated to tighten the nut onto the bolt, and as this occurs, the tip is sheared from the bolt. Thus, when the tip has been discharged from the tip receiving bore of the inner sleeve, the forward end of the inner sleeve is located in the nut receiving bore of the outer sleeve, and the stopper is restored to its original position by the biasing means. In this state, the engaging portion of the stopper is located in the engaging groove of the outer sleeve, restricting the axial movement of the inner sleeve and thence preventing a second nut from fitting into the nut receiving bore of the outer sleeve.

DETAILED DESCRIPTION OF THE PREFERRED EMBODIMENTS

Figure 1:
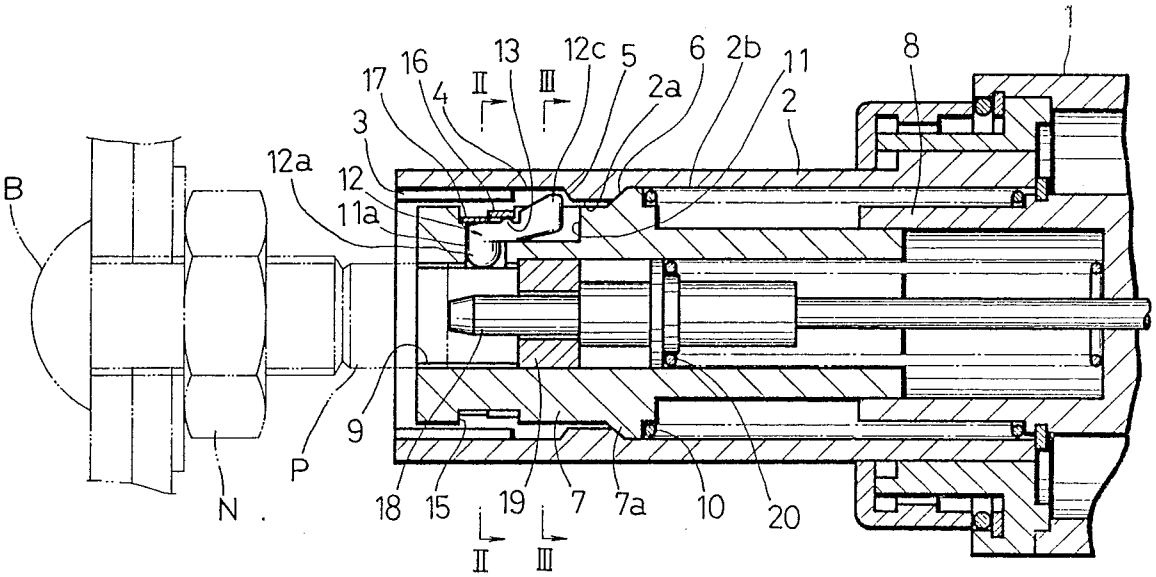
FIG. 1 is a side sectional view showing the essential parts of a bolt tightening tool according to a first embodiment of the present invention.
Figure 2:
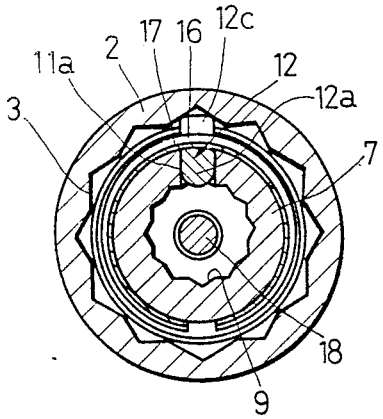
FIG. 2 is a sectional view taken along the line II—II of FIG. 1.

Referring to FIGS. 1 to 6, shown therein is a first embodiment of the present invention. In FIG. 1, reference numeral 1 designates a housing of a bolt tightening tool. A substantially cylindrical outer sleeve 2 is rotatably supported at the forward end of the housing 1. The outer sleeve 2 has formed on the inner periphery of the forward end thereof a polygonal, nut receiving bore 3 for fitting therein a nut N to be tightened (FIG. 2). The outer sleeve 2 is driven for rotation by an electric motor (not shown) disposed within the housing 1 through a suitable rotation transmitting mechanism. An annular engaging groove 4 of a predetermined width and depth is formed on the inner periphery of the outer sleeve 2 adjacent the rearward end (the right hand end as viewed in FIG. 1) of the nut receiving bore 3. The outer sleeve 2 also has a reduced-diameter bore 2*a* formed adjacent the rear end (the right hand end as viewed in FIG. 1) of the engaging groove 4 and an enlarged-diameter bore 2*b* formed adjacent the reduced-diameter bore 2*a*. Thus, the outer sleeve 2 has a sloping stopper face 5 located at the rear wall of the engaging groove 4 and a tapered face 6 located between the reduced-diameter bore 2*a* and the enlarged-diameter bore 2*b*.

A substantially cylindrical inner sleeve 7 is disposed within the outer sleeve 2, with its rearward end axially movably supported by a cylindrical support member 8 mounted within the housing 1. The inner sleeve 7 has formed on the inner periphery of the forward end thereof a polygonal, tip receiving bore 9 for fitting therein a tip P of a bolt B to be sheared therefrom (FIG. 2). At a medial portion of the outer periphery, the inner sleeve 7 is formed with a flange 7*a* disposed within the enlarged-diameter bore 2*b* of the outer sleeve 2. The flange 7*a* has on its forward end a tapered engaging face (unnumbered) which is formed in opposed relation to the tapered face 6 of the outer sleeve 2. The inner sleeve 7 is normally urged forwardly by a spring 10 interposed between the flange 7*a* and the support member 8, so that the forward end of the inner sleeve 7 is located generally at the forward end of the nut receiving bore 3 of the outer sleeve 2. In this state, the tapered engaging face of the flange 7*a* of the inner sleeve 7 is abuttingly engaged by the tapered face 6 of the outer sleeve 2, thereby restricting forward movement of the inner sleeve 7.

In the outer surface of the forward end of the inner sleeve 7, an axially elongated recess 11 is formed in generally opposed relation to the engaging groove 4 of the outer sleeve 2. The recess 11 has in its one end (the left side end as viewed in FIG. 1) a substantially eliptical aperture 11*a* which is of a width slightly smaller than the width of the engaging groove 4 of the outer sleeve 2 and which communicates with the tip receiving bore 9 of the inner sleeve 7.

Figure 4:
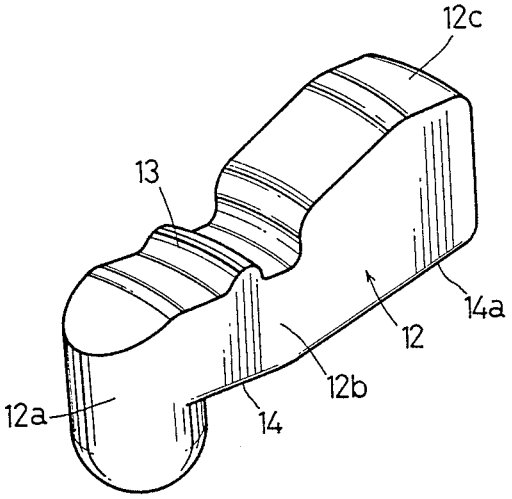
FIG. 4 is a perspective view of a stopper.

A stopper 12 is provided having a generally crank-shaped vertical cross-sectional configuration, as shown in FIG. 4, and is loosely and yet tiltably mounted within the recess 11. Specifically, the stopper 12 includes a base portion 12*a* loosely disposed in the aperture 11*a* of the recess 11 and having a spherical face on its lower end; a horizontal portion 12*b* extending from the base portion 12*a* and located within the recess 11; and an engaging portion 12*c* extending upwardly (as viewed in the drawing) from the rear end of the horizontal portion 12*b*. The upper forward end of the base portion 12*a* has a desired sloping face. The horizontal portion 12*b* has on its upper surface a substantially arcuate projection 13, and on its lower surface a joint portion 14 which joins with the base portion 12*a* and a sloping face 14*a* which extends from the joint portion 14 in a direction away from the bottom of the recess 11. The engaging portion 12*c* has on its forward end a sloping face similar to the sloping face 14*a* and on its rear end a rounded face to correspond to the inner periphery of the engaging groove 4 of the outer sleeve 2. It is to be noted that when the stopper 12 is pushed by the tip P as will be described hereinafter, the stopper 12 is tilted about a fulcrum indicated at S which is at the juncture of the joint portion 14 and the sloping face 14*a*.

Figure 5:
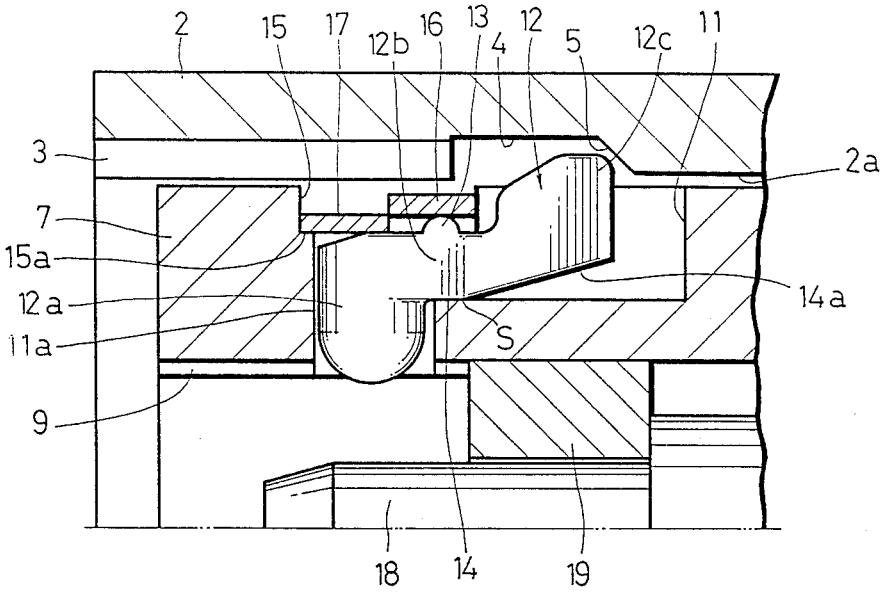
FIG. 5 is an enlarged side sectional view of the essential parts of the bolt tightening tool, illustrating the invention in its inoperative position before a tip of a bolt is fitted into the inner sleeve.
Figure 6:
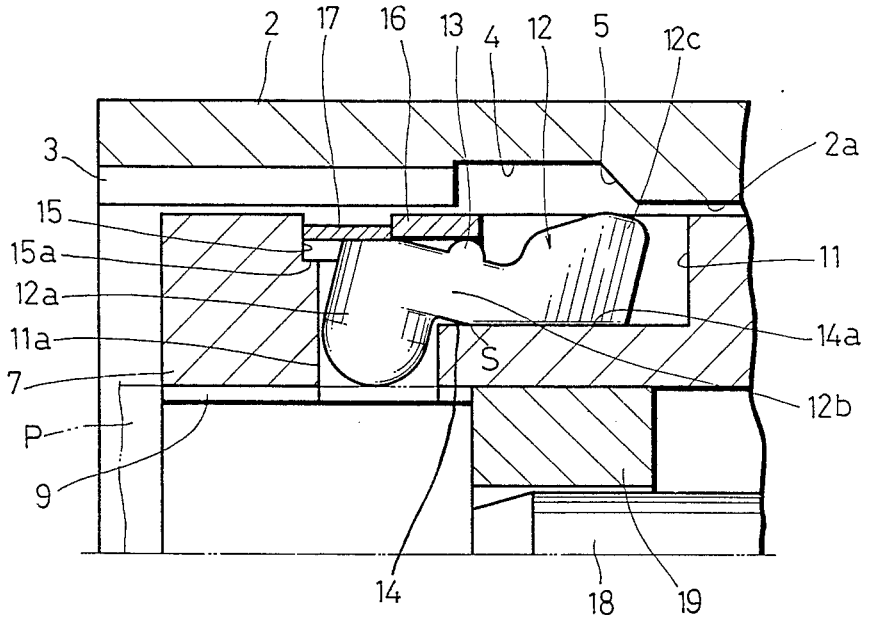
FIG. 6 is a view similar to FIG. 5, illustrating the tip fitted in the inner sleeve and the stopper in a tilted position.

As best shown in FIG. 5, the inner sleeve 7 has formed in the outer periphery thereof an annular mounting groove 15 which communicates with the forward end of the recess 11 and which is adapted to mount therein a first spring 16 and a second spring 17 now to be described. The first spring 16 is positioned in the mounting groove 15 in abutting engagement with the outer periphery of the projection 13 of the stopper 12, and the second spring 17 is juxtaposed with the first spring 16, extending over the bottom 15*a* of the mounting groove 15 and the upper surface of the base portion 12*a* of the stopper 12. The first and second springs 16 and 17 are annular plate springs having a cutout portion, as best shown in FIG. 2. The resilience of the first spring 16 is designed to be greater than that of the second spring 17. The arrangement of the first spring 16 is such that the biasing force thereof will act on the projection 13 and the joint portion 14 abutting on the recess 11, so as to move the stopper 12 into its tilted position shown in FIG. 6; and the arrangement of the second spring 17 is such that the biasing force thereof will assist the stopper 12 to return from the tilted position shown in FIG. 6 to the original position shown in FIG. 5.

With this arrangement, the spherical lower end of the base portion 12*a* of the stopper 12 normally projects slightly from the aperture 11*a* of the recess 11 into the tip receiving bore 9 of the inner sleeve 7, and the engaging portion 12*c* normally projects into the engaging grogroove 4 of the outer sleeve 2 with the joint portion 14 on the bottom of the recess 11. The inner sleeve 7 is then prevented from axial movement, particularly from rearward movement. Thus, when the tip P of the bolt B is fitted in the tip receiving bore 9, the tip P pushes up the base portion 12*a* in opposition to the biasing force of the springs 16 and 17. Under the pushing force exerted by the tip P and the biasing force of the first spring 16, the stopper 12 is caused to rotate clockwise (as viewed in FIGS. 5 and 6) about the fulcrum S, so that the engaging portion 12*c* retracts from the engaging groove 4, permitting the axial movement of the inner sleeve 7.

Figure 3:
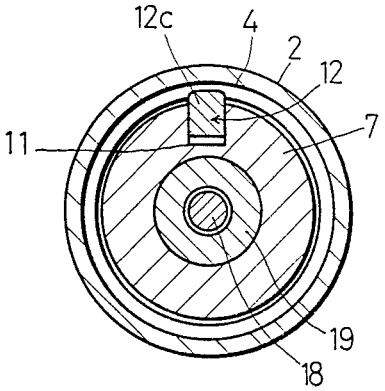
FIG. 3 is a sectional view taken along the line III—III of FIG. 1.

Turning now to FIGS. 1 to 3, a tip discharging rod 18 is provided in the bore of the inner sleeve 7 for axial reciprocating movement and is adapted to discharge the tip P when sheared. Specifically, the tip discharging rod 18 is guidingly supported generally on its forward section by a guide ring 19 fixedly mounted within the inner sleeve 7, and is normally biased forwardly by a spring 20 so that the forward end of the rod 18 is projected in the tip receiving bore 9. It is to be noted that the guide ring 19 is positioned rearwardly of the tip receiving bore 9 and serves to restrain the tip P from entering the tip receiving bore 9 more than is necessary and the tip discharging rod 18 from projecting forwardly more than is necessary.

The overall operation of the bolt tightening tool thus constructed is as follows.

When a nut N is to be tightened onto a bolt B, the tip receiving bore 9 of the inner sleeve 7 is fitted to the tip P of the bolt B. The inner sleeve 7 is then slightly retracted due to frictional resistance between the tip receiving bore 9 and the tip P against the action of the spring 10. As this occurs, the upper rear end of the engaging portion 12*c* of the stopper 12 is caused to engage the sloping stopper face 5 formed on the rear end wall of the engaging groove 4 of the outer sleeve 2.

As the tip P is advanced into the tip receiving bore 9 until it abuts on the guide ring 19, the base portion 12*a* of the stopper 12 is pushed upwardly by the tip P against the action of the first and second springs 16 and 17. During the tilting movement of the stopper 12, the upper sloping face of the base portion 12*a* abuts on and slightly pushes up the second spring 17 to increase the resilience thereof. It is to be noted that as the tip P is advanced in the tip receiving bore 9, the tip discharging rod 18 is retracted against the action of the spring 20.

In this state, the nut N to be tightened may be fitted in the nut receiving bore 3 of the outer sleeve 2. As the nut N is advanced in the nut receiving bore 3, the inner sleeve 7 is axially retracted against the action of the spring 10, permitting the nut N to be fitted in the nut receiving bore 3.

With the nut N fitted in the nut-receiving bore 3, the electric motor is driven to rotate the outer sleeve 2 and thus to tighten the bolt B and the nut N. As soon as the tightening operation is completed, the tip P in the tip receiving bore 9 of the inner sleeve 7 is sheared from the shank of the bolt B. The nut N is then disengaged from the nut receiving bore 3, thereby restoring the inner sleeve 7 to its original position under the action of the spring 10. Thus, the sheared tip P is discharged from the tip receiving bore 9 by the tip discharging rod 18. As this occurs, the stopper 12 is released from the pushing action of the tip P and therefore, is restored to its original position under the action of the first and second springs 16 and 17, causing the engaging portion 12*c* to project into the engaging groove 4 of the outer sleeve 2.

On the other hand, when the tip P is inadequately fitted in the tip receiving bore 9 of the inner sleeve 7, the stopper 12 is not tiltingly moved by the tip P, holding the engaging portion 12*c* of the stopper 12 and the stopper face 5 of the engaging groove 4 in their engaged position. The inner sleeve 7 is prevented from axial movement, thereby preventing the nut N from fitting into the nut receiving bore 3 of the outer sleeve 2.

From the foregoing description of the first embodiment, it can be seen that the biasing force acting on the fulcrum of tilting movement of the stopper 12 and the biasing force assisting the stopper 12 to return to its original position are exerted separately by the first spring 16 and the second spring 17. Thus, the tilting and returning movement of the stopper 12 may be effected very smoothly and positively.

Figure 7:
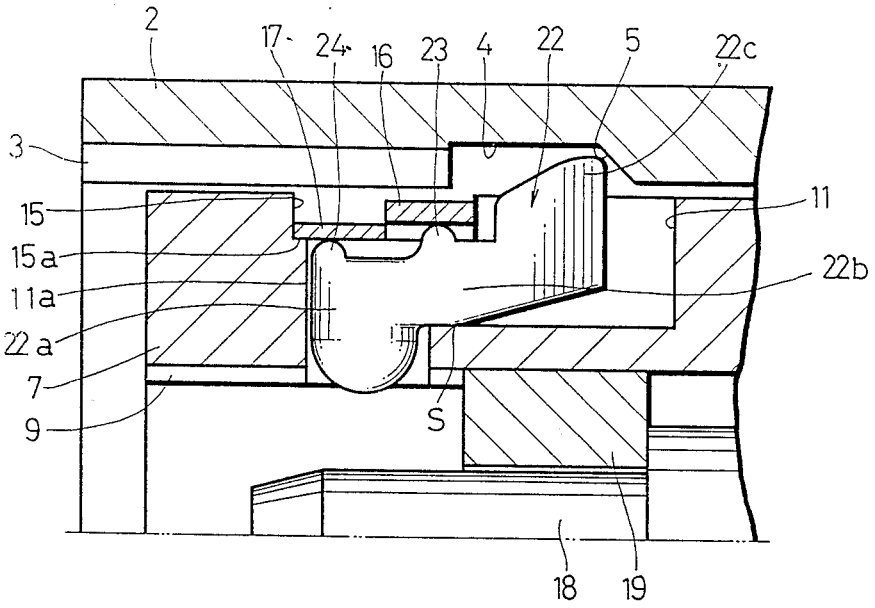
FIG. 7 is an enlarged side sectional view showing the essential parts of a second embodiment of the present invention.

FIG. 7 shows a second embodiment of the present invention, the same as the first embodiment insofar as the outer sleeve, inner sleeve and springs are concerned, but employing a modified stopper 22. Like parts are given like reference numbers.

In the first embodiment, the region where the stopper 12 abuts on the second spring 17 is of a sloping face, whereas the modified stopper 22 shown in FIG. 7 has an arcuate projection on which the spring 17 abuts. Specifically, the modified stopper 22 has a base portion 22*a*, a horizontal portion 22*b* and an engaging portion 22*c* corresponding to their counterparts 12*a*, 12*b* and 12*c* of the stopper 12 of the first embodiment. On the upper surface of the horizontal portion 22*b*, an arcuate projection 23 is formed corresponding to the projection 13 of the first embodiment, and on the forward upper surface of the base portion 22*a*, another arcuate projection 24 is formed which is similar to the projection 23 but which is disposed lower than the projection 23. As with the first embodiment, the second spring 17 is in contact with both the bottom face 15*a* of the fitting groove 15 and the outer surface of the projection 24. Thus, in this second embodiment, as the second spring 17 is in line-to-line contact with the stopper 22, the biasing force of the second spring 17 will effectively act on the stopper 22 to tiltingly return the latter to its original position.

Figure 8:
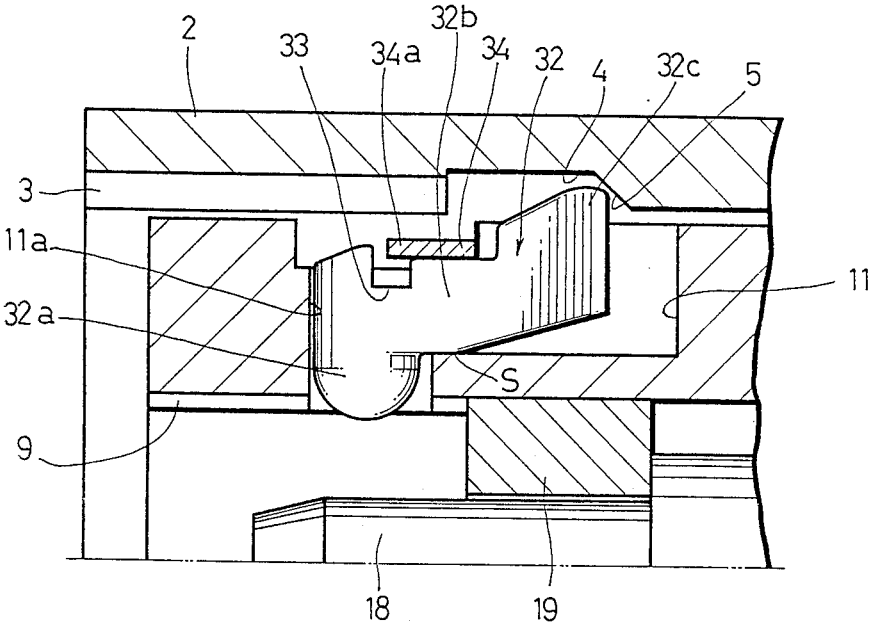
FIG. 8 is an enlarged side sectional view showing the essential parts of a third embodiment of the present invention.

FIG. 8 shows a third embodiment of the present invention. The difference in the third embodiment is that another modified stopper 32 is provided, and that a single spring 34 is provided corresponding to the springs 16 and 17 of the first embodiment. Like parts are given like reference numbers.

In the first embodiment described above, the biasing force acting on the fulcrum of tilting movement of the stopper 12 and the biasing force assisting the stopper 12 to return to its original position are exerted separately by the first and second springs 16 and 17, whereas in the third embodiment a single spring 34 is used in place of the springs 16 and 17. Specifically, as shown in FIG. 8, the stopper 32 has a base portion 32*a*, a horizontal portion 32*b* and an engaging portion 32*c* corresponding to their counterparts 12*a*, 12*b* and 12*c* of the stopper 12 of the first embodiment. The stopper 32 also has a transverse channel 33 formed in the upper surface thereof. A spring 34 is positioned on the upper surface of the horizontal portion 32*b* with its forward edge 34*a* projected partly over the channel 33, so that, when the stopper 32 is tilted, the forward edge 34*a* of the spring 34 may be projected into the channel 33. In other respects, the arrangement of this embodiment is the same as that of the first embodiment. Thus, in the third embodiment, the spring 34 is capable of accomplishing both actions described above, so that the number of components and thence the manufacturing cost of the bolt tightening tool may be reduced.

From the foregoing detailed description of the bolt tightening tool, it can be seen that the axial movement of the inner sleeve is controlled by the stopper tiltingly operated by the tip of the bolt to be tightened, so that the operation of the inner sleeve may be positively accomplished. Thus, the bolt tightening tool of the invention may ensure proper fitting of a nut and a tip of a bolt into an outer sleeve and an inner sleeve, respectively, so as to tighten the nut onto the bolt properly and improve the safety of operation. In addition, the bolt tightening tool of the invention is simple in construction and uses a reduced number of components and hence, it can be assembled easily and manufactured at lower cost.

While the invention has been described with reference to preferred embodiments thereof, it is to be understood that modifications or variations may be easily made without departing from the spirit of this invention which is defined by the appended claims.

What is claimed is:

1. A bolt tightening tool for tightening a nut onto a bolt, of the type driven by a motor, comprising:

an outer sleeve rotatably coupled to said motor and having a nut receiving bore for fitting therein a nut to be tightened, said outer sleeve having an engaging groove of a predetermined width formed adjacent said nut receiving bore;

an inner sleeve axially movably mounted within said outer sleeve and having a tip receiving bore for fitting therein a tip of a bolt to be sheared therefrom, said inner sleeve having an axial recess formed in the outer periphery of the forward end thereof in generally opposed relation to said engaging groove of said outer sleeve, and having an aperture formed in the forward end of said axial recess and communicating radially with said tip receiving bore;

a stopper tiltably mounted within said axial recess of said inner sleeve, said stopper having a base portion projectable into said tip receiving bore of said inner sleeve, an engaging portion projectable into said engaging groove of said outer sleeve, and a first horizontal portion formed between said base portion and said engaging portion, said first horizontal portion contacting the bottom of said axial recess of said inner sleeve, the contact point of said first horizontal portion being a fulcrum of tilting movement of said stopper; and biasing means for urging said base portion of said stopper to project radially into said tip receiving bore of said inner sleeve, for urging said engaging portion of said stopper to project into said engaging groove of said outer sleeve, and for urging said first horizontal portion of said stopper against the bottom of said axial recess of said inner sleeve;

whereby when a tip of a bolt is received in said tip receiving bore, said base portion of said stopper is pushed directly by the tip of the bolt in a radial direction so that said stopper is tilted and said engaging portion of said stopper is disengaged from said engaging groove of said outer sleeve.

2. The bolt tightening tool as defined in claim 1 wherein said stopper further includes a second horizontal portion formed between said base portion and said engaging portion and an arcuate projection formed on the upper surface of said second horizontal portion, and wherein said biasing means comprises a first and a second annular plate spring positioned around said inner sleeve, said first spring abuttingly engaging said projection of said second horizontal portion and normally acting on a fulcrum of tilting movement of said stopper for moving the latter into a tilted position, and said second spring abuttingly engaging the upper surface of said base portion for assisting said stopper to return from its tilted position to its original rest position.

3. The bolt tightening tool as defined in claim 1 wherein said stopper further includes a second horizontal portion formed between said base portion and said engaging portion, a first arcuate projection formed on the upper surface of said second horizontal portion, and a second arcuate projection formed on the forward upper surface of said base portion and disposed generally lower than said first projection, and wherein said biasing means comprises a first and a second annular plate spring positioned around said inner sleeve, said first spring abuttingly engaging said first projection of said second horizontal portion and normally acting on a fulcrum of tilting movement of said stopper for moving the latter into a tilted position, and said second spring abuttingly engaging said second projection of said base portion for assisting said stopper to return from its tilted position to its original rest position.

4. The bolt tightening tool as defined in claim 1 wherein said stopper further includes a second horizontal portion formed between said base portion and said engaging portion, and a transverse channel formed in the forward upper surface of said second horizontal portion, and wherein said biasing means comprises an annular plate spring positioned on the upper surface of said second horizontal portion with the forward edge thereof projected partly over said channel.

5. The invention defined by claim 1 wherein said biasing means is of substantially annular configuration positioned around the outer periphery of said inner sleeve and over said axial recess of said inner sleeve.

* * * * *